United States Patent [19]

Schild

[11] 4,030,467

[45] June 21, 1977

[54] CENTRIFUGAL ADJUSTING MECHANISM FOR IGNITION INTERRUPTERS OF INTERNAL COMBUSTION ENGINES

[75] Inventor: Ekkehard Schild, Ingolstadt, Germany

[73] Assignee: Bayerische Motoren Werke Aktiengesellschaft, Germany

[22] Filed: Aug. 4, 1975

[21] Appl. No.: 601,662

[30] Foreign Application Priority Data

Aug. 16, 1974 Germany ..... 2439366

[52] U.S. Cl. ..... 123/146.5 A; 200/31 CA

[51] Int. Cl.[2] ..... F02P 5/06

[58] Field of Search ..... 123/146.5 A; 200/31 CA

[56] References Cited

UNITED STATES PATENTS

| | | | |
|---|---|---|---|
| 3,613,652 | 10/1971 | Stellwagen | 123/146.5 A |
| 3,715,528 | 2/1973 | Habert | 200/31 CA |

*Primary Examiner*—Robert G. Nilson

*Attorney, Agent, or Firm*—Craig & Antonelli

[57] ABSTRACT

A centrifugal force adjusting mechanism for contact breakers of internal combustion engines, in which the main structural parts which include a drive shaft, an intermediate member and a contact breaker disk are rotatable with respect to one another in both directions of rotation against spring force by flyweights; the flyweights are thereby provided with two separate abutment surfaces which are so arranged in relation to the axis of rotation of the flyweights and the axis of rotation of the main structural parts that they are supported at counter surfaces of the main structural parts, on the one hand, in the direction of rotation of the drive shaft and on the other, opposite the direction of rotation of the drive shaft, whereby within a first rotational speed range of the drive shaft, the abutment surfaces and counter surfaces abut at one another in one direction of rotation whereas the other abutment surfaces and counter surfaces become operative only within a further rotational speed range.

11 Claims, 3 Drawing Figures

CENTRIFUGAL ADJUSTING MECHANISM FOR IGNITION INTERRUPTERS OF INTERNAL COMBUSTION ENGINES

The present invention relates to a centrifugal adjusting mechanism for an ignition contact breaker or interrupter of internal combustion engines consisting of coaxial structural main parts, namely of a drive shaft, of an intermediate member and of an interrupter shaft, rotatable relative to one another in both directions of rotations against a spring force by flyweights, whereby the flyweights supported at a main structural part are provided with abutment surfaces which cooperate with counter surfaces at the two other main structural parts.

An installation of this type of construction is disclosed in the German Offenlegungsschrift No. 1,601,426, which is composed of a driving distributor shaft with a distributor disk secured thereon, of an intermediate disk and of an interrupter or contact breaker disk non-rotatably connected with the interrupter or contact breaker shaft. Flyweights are supported at the intermediate disk and engage by means of the guide pins thereof in curved guide tracks of the distributor disk disposed therebelow and of the interrupter or contact breaker disk disposed thereabove. A pivoting out of the flyweights brings about a rotation of the intermediate disk with respect to the distributor disk and additionally a rotation of the interrupter disk with respect to the intermediate disk. The requirements for dimensional accuracy are very great due to the double guidance of the guide pins in curved guide tracks with small tolerances and as a result thereof, the manufacture of this prior art installation becomes very costly. Considerable friction forces occur at the guide tracks as a result of slide movements which cause a rapid wear and impair the function of the adjusting mechanism.

The aim of the present invention resides in so constructing an adjusting mechanism that the sliding friction in guide tracks or at abutment surfaces serving the purpose of entrainment is far-reachingly avoided. Furthermore, the adjusting mechanism is to be composed of as few as possible structural parts adapted to be manufactured in a simple manner which can be installed in a space-saving arrangement in the customary housing of ignition contact breakers or interrupters.

The underlying problems are solved according to the present invention in that the flyweights are provided with two separate abutment surfaces which in relation to the axes of rotation of the flyweights and the axes of rotation of the main structural parts are so arranged that they are supported at counter surfaces of the main structural parts, on the one hand, in the driving direction of the drive shaft, and, on the other, opposite to the driving direction of the drive shaft, whereby, within a first rotational speed range of the drive shaft, the abutment and counter surfaces effective in the one direction of rotation abut at one another, whereas the other abutment and counter surfaces come into operative connection only in a further rotational speed range.

An installation of the present invention which is constructed in this manner makes it possible to transmit the adjusting movement by way of simple abutment surfaces or counter surfaces without slide friction at lateral guide tracks. With the relatively small pivot angles of the flyweights which result in practice, the abutment and counter surfaces are at rest with respect to one another during the adjusting movement so that the slide friction together with its disadvantageous consequences is avoided. An optimum advanced ignition characteristic which results from the arrangement and dimensioning of the flyweights and springs, also remains preserved after a period of operation over many years.

In a preferred embodiment of the present invention, a base plate is non-rotatably connected with the drive shaft, at which two flyweights are supported on diametrically opposite pins with respect to the axis of rotation of the main structural parts, whereas an interrupter or contact breaker disk is non-rotatably connected with the interrupter or contact breaker shaft. The contact breaker disk is held in abutment with respect to the intermediate member by prestressed drawsprings and the intermediate member is held in abutment with respect to the base plate by prestressed drawsprings, which are respectively anchored therebetween and are effective opposite the direction of rotation of the drive shaft. The one abutment surfaces of the flyweights are supported over the entire rotational speed range at counter surfaces of the intermediate member in the direction of rotation of the drive shaft whereas the other abutment surfaces of the flyweights, during standstill of the drive shaft, are arranged at a predetermined angular distance to the counter surfaces of the contact breaker disk and beginning with a predetermined rotational speed of the drive shaft are supported at the counter surfaces of the contact breaker disk opposite the direction of rotation of the drive shaft.

Simple punched or stamped out parts may be used for the contact breaker disk, the intermediate member and the base plate, of which no high demands are made as regards the maintenance of tolerances. An inaccurate manufacture of the parts can be compensated readily by changing the spring prestress and has no disadvantageous influence on the function of the adjusting mechanism.

Accordingly, it is an object of the present invention to provide a centrifugal adjusting mechanism for ignition contact breakers of internal combustion engines which avoids by simple means the afore-mentioned shortcomings and drawbacks encountered in the prior art.

Another object of the present invention resides in a centrifugal adjusting mechanism for a contact breaker meachanism of internal combustion engines which eliminates the need for narrow tolerances as regards the dimensions of its parts and thereby considerably reduces the cost of manufacture thereof.

A further object of the present invention resides in a centrifugal force adjusting mechanism of the type described above in which a rapid wear is effectively eliminated and a completely satisfactory operation of the mechanism is assured over long operating periods.

Still a further object of the present invention resides in a centrifugal force adjusting mechanism for contact breaker devices of internal combustion engines which is simple in construction, can be assembled and built in a space-saving manner into the customary housing of ignition contact breakers and is able to transmit the adjusting movement substantially without slide friction.

A further object of the present invention resides in a centrifugal force adjusting mechanism for ignition contact breakers of internal combustion engines in which inaccuracies in the manufacture can be readily compensated.

These and other objects, features and advantages of the present invention will become more apparent from the following description when taken in connection with the accompany drawing which shows, for purposes of illustration only, one embodiment in accordance with the present invention, and wherein.

Figure 1:
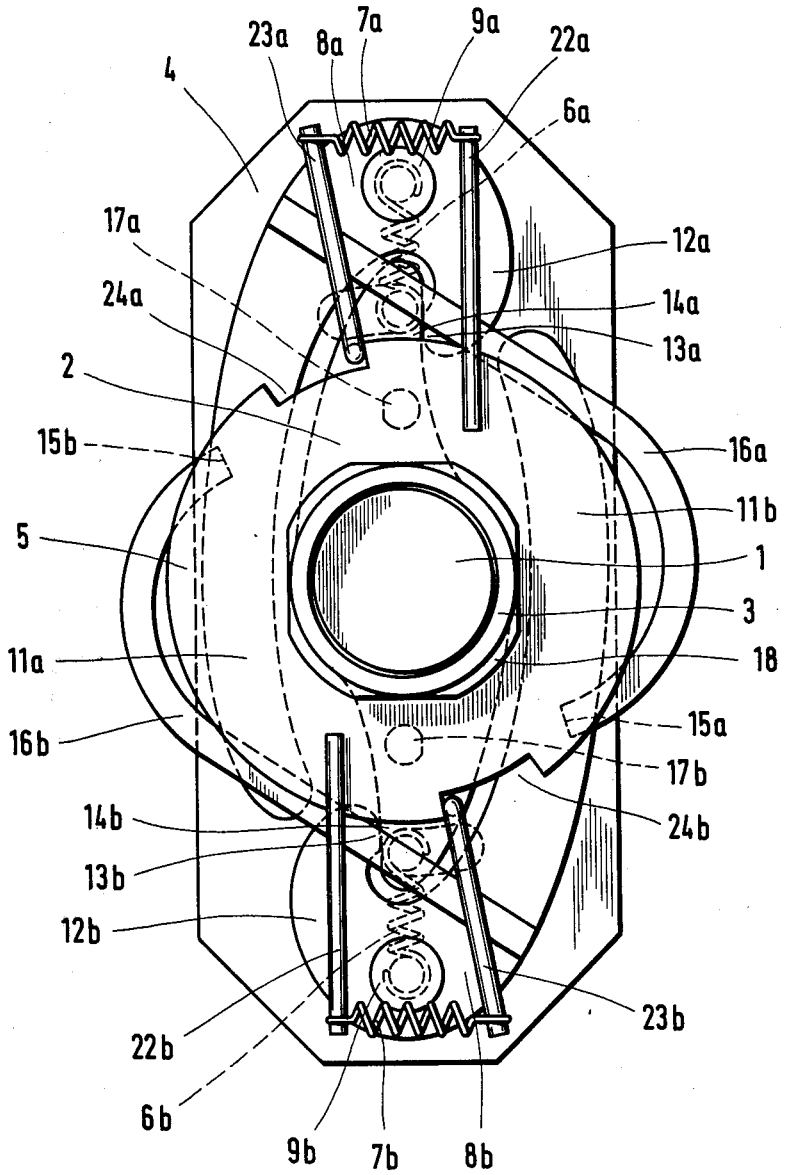
FIG. 1 is a top plan view on a centrifugal force adjusting mechanism for ignition contact breaker devices of internal combustion engines.
Figure 2:
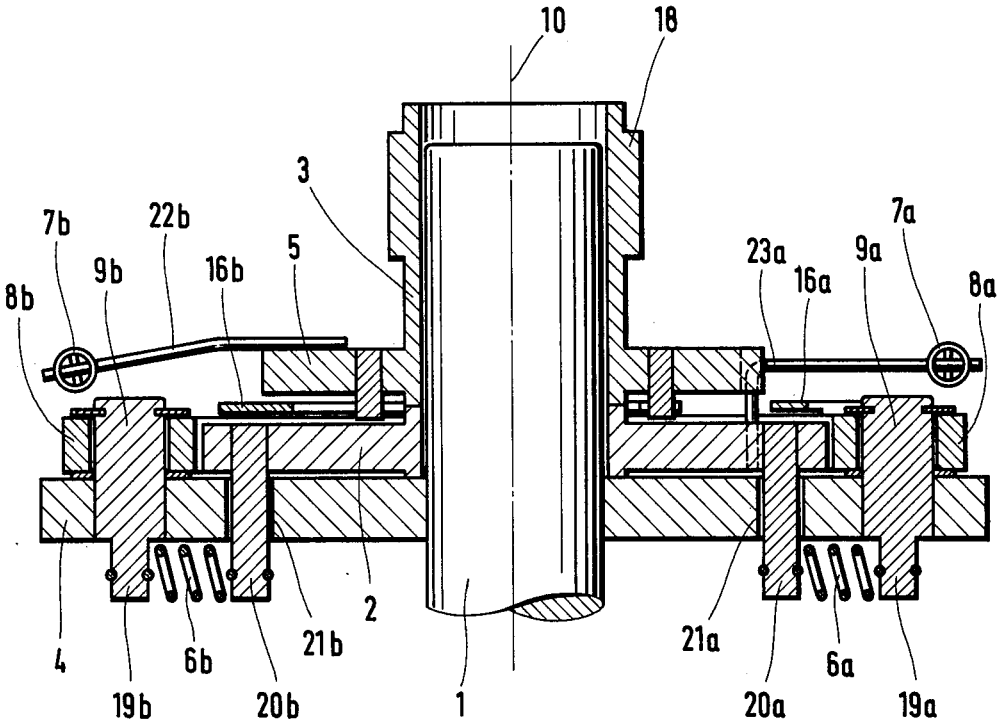
FIG. 2 is a longitudinal cross sectional view through FIG. 1.

Referring now to the drawing wherein like reference numerals are used throughout the various views to designate like parts, the centrifugal force adjusting mechanism according to FIGS. 1 and 2 essentially consists of three main structural parts, namely of the drive shaft 1, of the intermediate member 2 and of the contact breaker shaft 3. The base plate 4 is non-rotatably connected with the vertically disposed drive shaft 1 while the contact breaker disk 5 is non-rotatably connected with the contact breaker shaft 3. The base plate 4, the intermediate member 2 and the contact breaker disk 5 are arranged coaxially one above the other and are rotatable with respect to one another. The drawsprings 6*a* and 6*b* anchored between the base plate 4 and the intermediate member 2, as well as the drawsprings 7*a* and 7*b* disposed between the contact breaker plate 5 and the intermediate member 2, counteract the rotation therebetween. The flyweights 8*a* and 8*b* are supported at the base plate 4 on pins 9*a* and 9*b*, which are secured in the base plate 4 diametrically from the axis 10 of the main structure parts 1, 2 and 3. The flyweights 8*a* and 8*b* are constructed double armed and crescent shaped, as a symmetrical pair and surround the axis 10 of the main structural parts from both sides with the longer lever arms 11*a* and 11*b* thereof. The abutment surfaces 13*a* and 13*b* (FIG. 1) are provided at the shorter lever arms 12*a* and 12*b* of the flyweights 8*a* and 8*b*, which abut at the counter surfaces 14*a* and 14*b* of the intermediate member 2.

The free ends of the curved return members 16*a* and 16*b* rigidly connected with the flyweights 8*a* and 8 *b* are provided with further abutment surfaces 15*a* and 15*b*; the curved return members 16*a* and 16*b* are formed arcuately shaped within the area of the axis 10 of the main structural parts and enclose the axis 10 on the side opposite the respective longer lever arms 11*a* and 11*b* of the flyweights 8*a* and 8*b*. During standstill of the drive shaft 1, the abutment surfaces 15*a* and 15*b* have a predetermined angular spacing with respect to the counter surfaces 17*a* and 17*b* of the contact breaker disk 5. Beginning with a predetermined rotational speed of the drive shaft 1, the abutment surfaces 15*a* and 15*b* of the curved return members 16*a* and 16*b* come into abutment at the counter surfaces 17*a* and 17*b* of the contact breaker disk 5. The contact breaker shaft 3 non-rotatably connected with the contact breaker disk 5 is constructed as hollow shaft and carries externally the contact breaker cam 18.

The intermediate member 2 and the contact breaker disk 5 are rotatably supported on the drive shaft 1. The drawsprings 6*a* and 6*b* which counteract a rotation of the intermediate member 2 with respect to the drive shaft 1, are suspended at the lower ends 19*a* and 19*b* of the pins 9*a* and 9*b* and at the pins 20*a* and 20*b* secured at the intermediate member 2. With a rotation of the intermediate member 2 with respect to the drive shaft 1, the pins 20*a* and 20*b* move without contact along the elongated apertures 21*a* and 21*b* of the base plate 4 which serve simultaneously as end abutments of the rotary movement. The drawsprings 7*a* and 7*b* effective between the contact breaker disk 5 and the intermediate member 2 are suspended at lugs 22*a* and 22*b* of the contact breaker disk 5 as well as at the angular abutments 23*a* and 23*b* of the intermediate member 2. The springs 7*a* and 7*b* effect that the contact breaker disk 5 is held in abutment with its recesses 24*a* and 24*b* with respect to the angular abutments 23*a* and 23*b*.

The relative rotation of the main structural parts is caused in that beginning with a predetermined rotational speed of the drive shaft 1, a deflection of the flyweights 8*a* and 8*b* takes place which is caused by the centrifugal force. The intermediate member 2 is rotated in the counterclockwise direction with respect to the base plate 4 by way of abutment surfaces 13*a* and 13*b* and the counter surfaces 14*a* and 14*b*.

The contact breaker disk 5 which is operatively connected with the intermediate member 2 by way of the springs 7*a* and 7*b* and therewith the contact breaker cam 18 is also rotated in the counterclockwise direction. If the drive shaft 1 rotates in the counterclockwise direction, there results therefore an advancing of the contact breaker cam 18 and therewith an advanced ignition which becomes larger with an increasing rotational speed (Range A in FIG. 3). The curved return members 16*a* and 16*b* thereby pivot with the abutment surfaces 15*a* and 15*b* toward the counter surfaces 17*b* and 17*a* of the contact breaker disk 5. As soon as the deflection of the flyweights 8*a* and 8*b* has become so large that the curved return members 16*a* and 16*b* come into abutment with their abutment surfaces 15*a* and 15*b* at the counter surfaces 17*b* and 17*a*, the contact breaker disk 5 is rotated in the clockwise direction. The abutment surfaces of the recesses 24*a* and 24*b* lift off from the angular abutments 23*a* and 23*b* and the drawsprings 7*a* and 7*b* are additionally stressed whereas the intermediate member 2 continues to be rotated in the counterclockwise direction by the abutment surfaces 13*a* and 13*b*.

Figure 3:
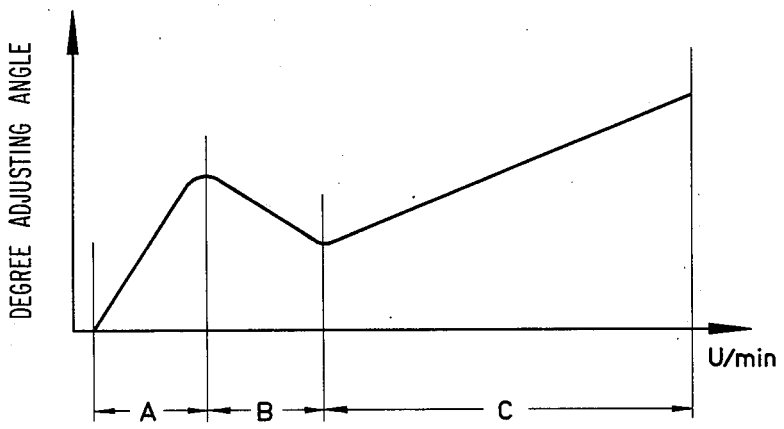
FIG. 3 is a diagram illustrating the ignition characteristics obtainable with the present invention.

Consequently, a return adjustment or delay of the advance ignition takes place (Range B in FIG. 3).

If one constitutes the curved return members 16*a* and 16*b* so as to be elastically springy and matches the spring characteristics thereof to the characteristics of the drawsprings 6*a* and 6*b* and 7*a* and 7*b*, it is possible to achieve that the advanced ignition characteristic curve again increases after a minimum within the middle rotational speed range (Range C in FIG. 3). This configuration of the advanced ignition characteristic is desirable in internal combustion engines which have a greater tendency for knocking in the middle rotational speed range than in the upper rotational speed range.

In lieu of the curved return members, the flyweights may also be provided with abutments which upon reaching a predetermined flyweight deflection take along the contact breaker disk in the clockwise direction. For that purpose, side bars or lugs with elongated apertures may be provided at the longer lever arms. Two entrainment pins fastened at the contact breaker disk move within the first rotational speed range along the elongated apertures and come into abutment within a further rotational speed range.

The operation of the adjusting mechanism according to the present invention also remains preserved when the flyweights are supported at the contact breaker disk. In this case, exclusively the springs and flyweights have to be differently matched to one another.

While I have shown and described only one embodiment in accordance with the present invention, it is understood that the same is not limited thereto but is susceptible of numerous changes and modifications as known to those skilled in the art and I therefore do not wish to be limited to details shown and described herein but intend to cover all such changes and modifications as are encompassed by the scope of the appended claims.

I claim:

1. A centrifugal force adjusting mechanism for ignition contact breakers of internal combustion engines, which includes a plurality of co-axial main structural parts rotatable with respect to one another and flyweights operative to rotate said main structural parts against spring forces to effect advance and delay adjustment in a plurality of rotational speed ranges, characterized by a pair of said flyweights supported at a first of said main structural parts, each flyweight of said pair having first abutment surface means being in driving abutment against first counter surface means on a second of said main structural parts in at least a first rotational speed range to effect relative rotation of said main structural parts in a first direction of adjustment, and each flyweight of said pair being associated with second abutment surface means adapted to drivingly abut second counter surface means on a third of said main structural parts only in a second rotational speed range to effect relative rotation of said main structural parts in a second opposite direction of adjustment.

2. An adjusting mechanism according to claim 1, characterized in that said first direction of adjustment corresponds to an advance and said second direction of adjustment corresponds to a delay in ignition timing.

3. An adjusting mechanism according to claim 1, characterized in that said second of said main structural parts includes an intermediate member, and in that the main structural parts further include a drive shaft and a contact breaker shaft.

4. An adjusting mechanism according to claim 3, in which said first of said main structural parts is a base plate means non-rotatably connected with the drive shaft, said pair of flyweights being supported at the base plate means on pins disposed substantially diametrically opposite with respect to the axis of rotation of the main structural parts, and in which said third of said main structural parts is a contact breaker disk means non-rotatably connected with the contact breaker shaft, characterized in that the contact breaker disk means is held in abutment with respect to the intermediate member, and the intermediate member is held in abutment with respect to the base plate means by way of corresponding prestressed drawspring means which are anchored respectively therebetween and which act effectively opposite to the direction of rotation of the drive shaft.

5. An adjusting mechanism according to claim 4, characterized in that said first abutment surface means of said pair of flyweights are supported in the direction of rotation of the drive shaft over the entire rotational speed range at said first counter surface means at said intermediate member, whereas during standstill of the drive shaft said second abutment surface means of said pair of flyweights are at a predetermined angular distance from said second counter surface means at said contact breaker disk means.

6. An adjusting mechanism according to claim 5, characterized in that said second abutment surface means of the flyweights, beginning with a predetermined rotational speed of the drive shaft, are supported at said second counter surface means to move the contact breaker disk means opposite to the direction of rotation of the drive shaft.

7. An adjusting mechanism according to claim 6, characterized in that said first abutment surface means of said pair of flyweights are arranged within the area between the axis of rotation of the flyweights and the axis of rotation of the main structural parts, whereas said second abutment surface means of said pair of flyweights are arranged outside this area.

8. An adjusting mechanism according to claim 7, characterized in that curved return means are fixedly mounted at each of said pair of flyweights, said curved return means surrounding the axis of rotation of the main structural parts and being arcuately shaped, and said curved return means having free ends being constructed as said second abutment surface means.

9. An adjusting mechanism according to claim 8, characterized in that the curved return means are constructed elastically springingly, and that the spring characteristics thereof are so matched to the spring characteristics of said prestressed drawspring means disposed between the main structural parts such that a non-rectilinear advanced igntiton curve with a minimum within a middle rotational speed range is attained.

10. An adjusting mechanism according to claim 1, characterized in that curved return means are fixedly mounted at each of said pair of flyweights, said curved return means surrounding the axis of rotation of the main structural parts and being arcuately shaped, and said pg,15 curved return means having free ends being constructed as said second abutment surface means.

11. An adjusting mechanism according to claim 10, characterized in that the curved return means are constructed elastically springingly, and that the spring characteristics thereof are so matched to spring characteristics of spring means disposed between the main structural parts such that a non-rectilinear advanced ignition curve with a minimum within a middle rotational speed range is attained.

* * * * *